US008596913B2

(12) United States Patent
Li

(10) Patent No.: US 8,596,913 B2
(45) Date of Patent: Dec. 3, 2013

(54) FREE STANDING STEEL CATENARY RISERS

(75) Inventor: You Sun Li, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/148,483

(22) PCT Filed: Feb. 8, 2010

(86) PCT No.: PCT/US2010/023455
§ 371 (c)(1),
(2), (4) Date: Sep. 16, 2011

(87) PCT Pub. No.: WO2010/093577
PCT Pub. Date: Aug. 19, 2010

(65) Prior Publication Data

US 2011/0318110 A1 Dec. 29, 2011

Related U.S. Application Data

(60) Provisional application No. 61/151,273, filed on Feb. 10, 2009.

(51) Int. Cl.
*E21B 17/01* (2006.01)

(52) U.S. Cl.
USPC ..... 405/171; 405/158; 405/168.1

(58) Field of Classification Search
USPC ..... 405/158, 166, 168.1, 171, 172, 173
See application file for complete search history.

(56) References Cited

U.S. PATENT DOCUMENTS

| | | | | |
|---|---|---|---|---|
| 4,892,495 | A * | 1/1990 | Svensen | 441/5 |
| 6,062,769 | A * | 5/2000 | Cunningham | 405/195.1 |
| 6,109,833 | A * | 8/2000 | Savy | 405/195.1 |
| 6,257,801 | B1 * | 7/2001 | Kelm et al. | 405/224.2 |
| 6,854,930 | B2 * | 2/2005 | Pionetti | 405/172 |
| 7,628,568 | B2 * | 12/2009 | Critsinelis | 405/169 |
| 2003/0161690 | A1 | 8/2003 | Breivik et al. | 405/224.2 |
| 2005/0063788 | A1 | 3/2005 | Clausen | 405/224.2 |
| 2005/0140726 | A1 | 6/2005 | Silverbrook | 347/47 |
| 2005/0158126 | A1 * | 7/2005 | Luppi | 405/224.2 |
| 2005/0254900 | A1 * | 11/2005 | Pionnetti | 405/169 |
| 2006/0062635 | A1 * | 3/2006 | Mungall et al. | 405/158 |
| 2006/0178063 | A1 | 8/2006 | Dupre | 441/133 |
| 2007/0081862 | A1 * | 4/2007 | Wolbers et al. | 405/169 |
| 2008/0253842 | A1 * | 10/2008 | Wolbers et al. | 405/169 |

FOREIGN PATENT DOCUMENTS

| | | | |
|---|---|---|---|
| WO | WO2008036728 | 3/2008 | E02C 5/02 |
| WO | WO2008042943 | 4/2008 | E02B 1/00 |

* cited by examiner

*Primary Examiner* — Benjamin Fiorello

(57) ABSTRACT

An offshore riser system comprising a tubular from a sea floor to a sea surface comprising a first horizontal portion at the sea floor; a second vertical portion near the sea surface; and a third curved portion located between the first and second portions; and a buoyancy module connected to the second portion, adapted to maintain a shape of the curved portion and enable a connection of a vessel to the second portion.

7 Claims, 3 Drawing Sheets

FREE STANDING STEEL CATENARY RISERS

PRIORITY CLAIM

The present application claims priority from PCT/US2010/023455, filed 8 Feb. 2010, which claims priority from U.S. Provisional Application No. 61/151,273, filed 10 Feb. 2010.

FIELD OF THE INVENTION

The invention generally relates to a free standing steel catenary riser that can be preinstalled before host arrival.

BACKGROUND OF THE INVENTION

PCT Publication number WO2008042943, discloses a floating system positioned in a body of water having a water bottom, the system comprising a host member floating on a surface of the water; a flotation module floating under the surface of the water; a flexible hose connecting the host member to the flotation module; and an elongated underwater line structure, comprising a top portion connected to the flotation module; a bottom portion extending to the water bottom and adapted to connect to a flowline lying on the water bottom; and at least one of the top portion and the bottom portion comprising a catenary configuration. PCT Publication number WO2008042943 is herein incorporated by reference in its entirety.

PCT Publication number WO2008036728, discloses a floating system positioned in a body of water having a water bottom, the system comprising a host member floating in the water; an elongated underwater line structure, comprising a top connected to the host; a bottom extending to the seabed and adapted to connect to a flowline lying on the seabed; a first portion of the line structure being shaped concave upward; a second portion of the line structure being shaped concave upward; and a transition segment between being shaped concave downward, the transition segment located between the first portion and the second portion. PCT Publication number WO2008036728 is herein incorporated by reference in its entirety.

SUMMARY OF THE INVENTION

One aspect of the invention provides an offshore riser system comprising a tubular from a sea floor to a sea surface comprising a first horizontal portion at the sea floor; a second vertical portion near the sea surface; and a third curved portion located between the first and second portions; and a buoyancy module connected to the second portion, adapted to maintain a shape of the curved portion and enable a connection of a vessel to the second portion.

Another aspect of the invention provides a method of installing an offshore riser system comprising laying a first horizontal portion of a tubular on a sea floor; connecting a second vertical portion of the tubular to a flotation module at or near a sea surface; forming a third curved portion between the first horizontal portion and the second vertical portion; connecting the second portion to a floating host vessel; and disconnecting the flotation module from the second portion.

DETAILED DESCRIPTION OF THE DRAWINGS

Exemplary embodiments of the invention will be described with reference to the accompanying figures. Like items in the figures are shown with the same reference numbers.

In embodiments disclosed herein, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Offshore drilling and production may use a pipeline extending from the offshore production site on the seafloor, where the fluid product is extracted, to a product storage area. In one example of offshore drilling and production, the product storage area is disposed on a host vessel to which the pipeline is connected to allow for the fluid product to flow into the product storage area. An example of such a pipeline is a steel catenary riser.

One or more embodiments of the disclosure relates to a buoyancy device for a steel catenary riser that allows the steel catenary riser to be pre-installed prior to arrival of a host vessel, while maintaining a catenary profile such that the steel catenary riser can be immediately attached to the host vessel upon its arrival, and fluid product can be extracted from the offshore drilling site without waiting for installation of the steel catenary riser after arrival of the host vessel.

FIGS. 1-2:

A pipeline 17 may be formed into a steel catenary riser 20 using any of various different installation methods, several examples of which are detailed below. However, the installation methods are given below only as examples, and embodiments of the present disclosure are not limited thereto.

Figure 1:
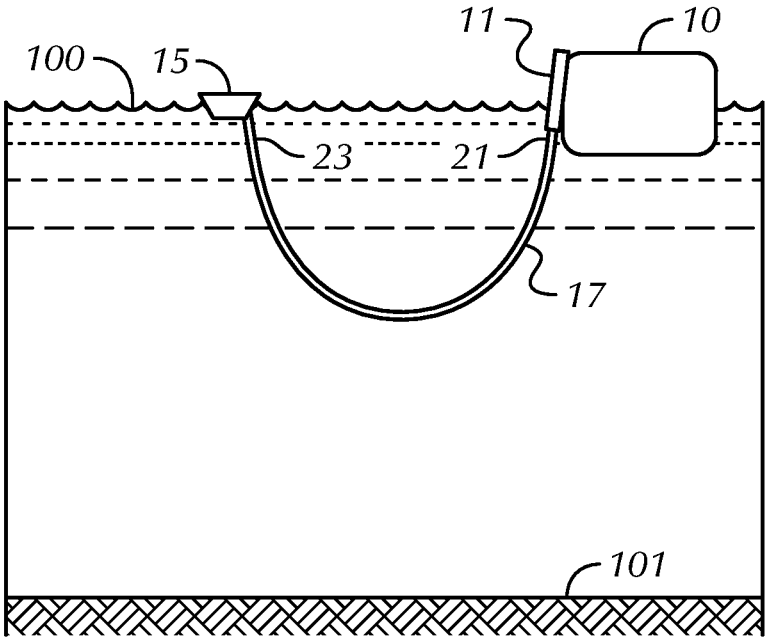
FIG. 1 shows an example of a steel catenary riser during installation according to one or more embodiments of the present disclosure.
Figure 2:
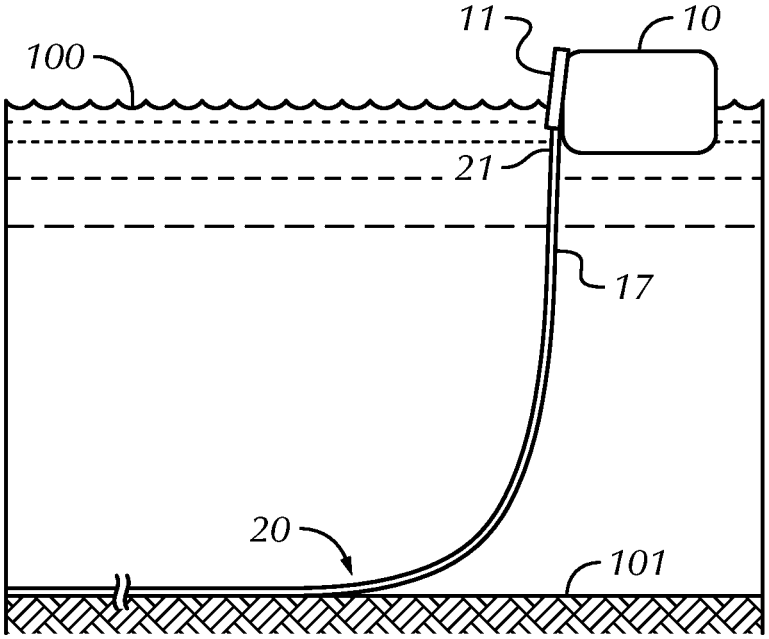
FIG. 2 shows an example of a steel catenary riser after installation according to one or more embodiments of the present disclosure.

FIGS. 1-2 show one example of a steel catenary riser installation. A host vessel 10, which floats on a body of water 100, and which may be, for example, a large tanker, initially contains the pipeline 17 that will form the steel catenary riser 20. A distal end 23 of the pipeline 17 is attached to a secondary vessel 15, e.g., a tugboat, that is generally smaller and more mobile than the host vessel 10.

The host vessel 10, which stays substantially stationary, incrementally lowers the pipeline 17 for a first period while the secondary vessel 15 travels away from the host vessel 10. Although here, the pipeline is shown being lowered through a receptacle 11 to which a near end 21 of the pipeline 17 is attached, the pipe may also be lowered from other sections of the host vessel 10. The host vessel 10 then ceases lowering the pipeline 17 while the secondary vessel 15 moves back toward the host vessel 10 for a second period. The host vessel 10 then again incrementally lowers the pipeline 17 for a third period while the secondary vessel 15 travels away from the host vessel 10. This process is repeated until the pipeline 17 contacts the seabed 101. Each period may be a predetermined time interval or may be determined based on the length of pipeline lowered.

When the pipeline 17 contacts the seabed 101, the secondary vessel 15 moves proximate to the host vessel 10 to ensure a desired catenary profile of the pipeline 17, which is a smooth curve between the horizontal portion of the pipeline 17 on the seabed 101 to the substantially vertical portion of the pipeline 17 which attaches to the receptacle 11. The secondary vessel 15 then moves to a location above the offshore production site and releases the distal end 23 of the pipeline 17. This process of lowering the pipeline 17 creates the desired catenary profile with the pipeline 17, while avoiding unnecessary bending stresses on the pipeline 17.

The installed steel catenary riser is shown in FIG. 2. The pipeline 17 forms a steel catenary riser 20, a near end 21 of which is attached to the host vessel 10, and the distal end 23 of which is connected to the offshore production site (not shown). The pipeline 17 that makes up the steel catenary riser 20 comes off the host vessel 10 at a small angle from perpendicular to the seabed 101. As the pipeline 17 extends deeper into the body of water 100, the angle grows larger, until the pipeline 17 is substantially perpendicular to the seabed 101. Proximate to the seabed 101, the pipeline 17 makes a curve that becomes substantially parallel as the pipeline 17 contacts the seabed 101. A large portion of the steel catenary riser 20 rests on the seabed 101, extending to the offshore production site (not shown). The steel catenary riser 20 efficiently and cost-effectively delivers fluid product to the host vessel 10.

Figure 3:
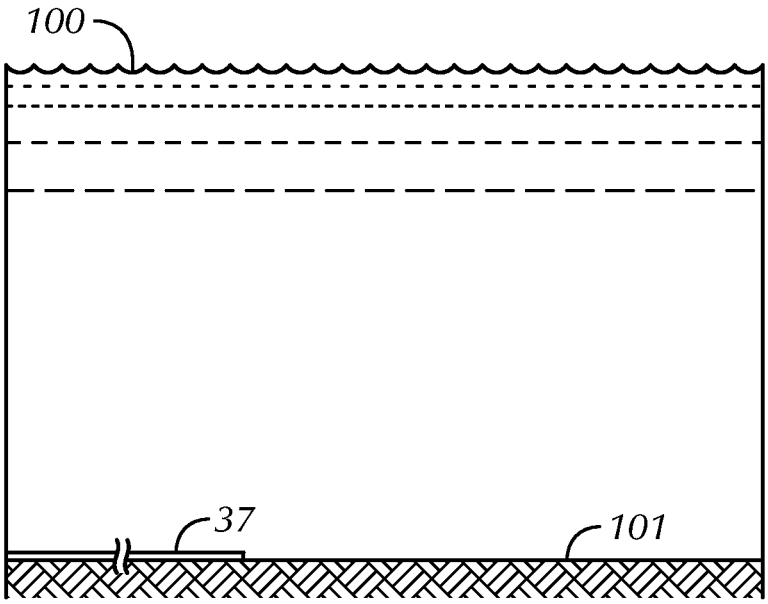
FIG. 3 shows an example of a steel catenary riser during installation according to one or more embodiments of the present disclosure.
Figure 4:
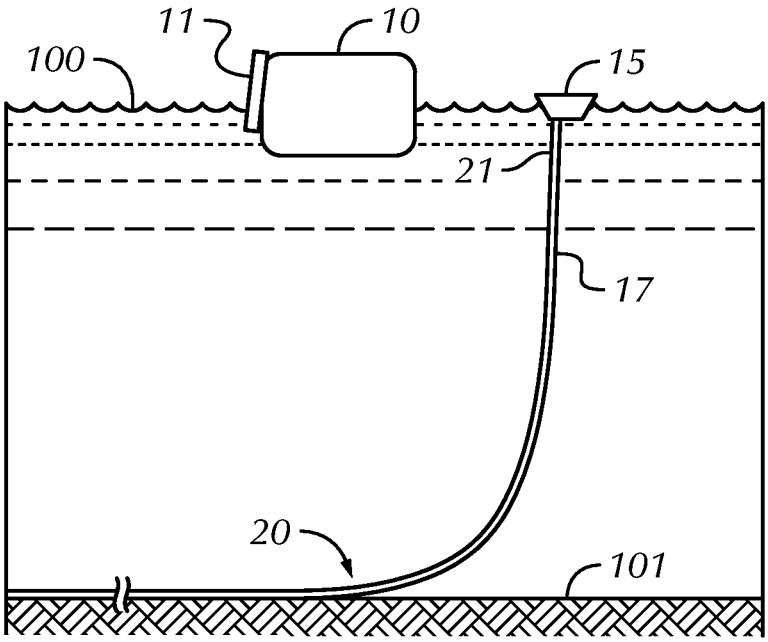
FIG. 4 shows an example of a steel catenary riser during installation according to one or more embodiments of the present disclosure.

FIGS. 3-4:

FIGS. 3-4 show another example of steel catenary riser installation. As shown in FIG. 3, the section of the pipeline 37 that rests on the seabed 101 may be laid down before host arrival and abandoned on the seafloor 37. That is, the pipeline 37 may be partially installed, and abandoned on the seafloor so that the remainder of the pipeline 17 can be installed at a later date.

As shown in FIG. 4, at the later date, the host vessel 10 arrives, and the partially installed pipeline 37 is retrieved from the site and attached to additional pipeline 17. The near end 21 of the additional pipeline 17 is attached to a smaller, more mobile secondary vessel 15, which continues the laying process as described above with reference to FIGS. 1 and 2, and the additional pipeline 17 is formed into a riser portion of the steel catenary riser 20. The near end 21 of the steel catenary riser 20 is then attached to the receptacle 11 of the host vessel 10, at which point the steel catenary riser 20 will have a similar catenary profile as that shown in FIG. 2.

Alternatively, the riser portion of the steel catenary riser 20 may be included at the seabed before abandonment, in which case the riser portion is laid out along a curve on the seafloor 101, and the near end 21 of the pipeline 17 will be at a location on the seabed 101 apart from a location directly under where the host vessel 10 will arrive. In this case, the secondary vessel 15 or some other construction vessel retrieves the near end 21 from the seafloor, and the near end 21 is attached to the receptacle 11 of the host vessel 10.

Figure 5:
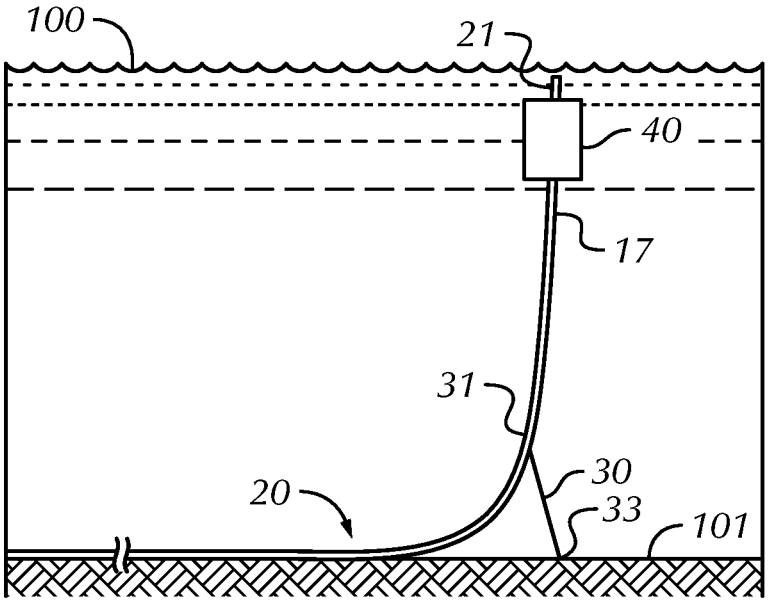
FIG. 5 shows a free-standing mode of a free standing steel catenary riser according to one or more embodiments of the present disclosure.
Figure 6:
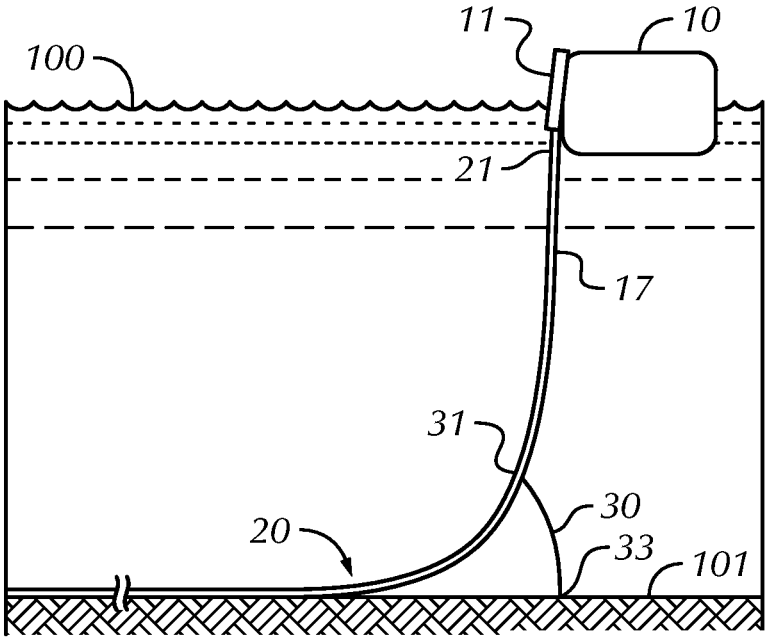
FIG. 6 shows a connection mode of a free standing steel catenary riser according to one or more embodiments of the present disclosure.

FIGS. 5-6:

FIG. 5 shows a free-standing mode and FIG. 6 shows a host connection mode of a free-standing steel catenary riser system according to one or more embodiments of the present disclosure.

As shown in FIG. 5, the steel catenary riser 20 is pre-installed before host vessel arrival. The pre-installation may be accomplished by any installation method. The pipeline 17 is formed into the catenary profile as with the steel catenary riser 20 shown in FIG. 2, except that the near end 21 of the pipeline that normally attaches to the host vessel 10 is free, and a buoyancy device 40 is attached proximate the near end 21. The buoyancy device 40 may include one or more of a buoyancy foam, an air can, a buoy, or other buoyancy devices known in the art. The buoyancy device 40 may be detachably attached around the pipeline 17. The buoyancy device 40 may be attached to the pipeline 17 by one or more of a clamping mechanism, welding, bonding, and other attachment methods known in the art. The buoyancy device 40 may be attached to the pipeline 17 after the near end 21 is attached to a vessel at the surface. The distal end 23 of the pipeline is connected to the offshore production site (not shown).

The buoyancy device 40 provides an upward buoyancy force to the near end 21 of the pipeline 17 such that the catenary profile of the steel catenary riser 20 is maintained. A bottom load required to maintain the catenary profile may be provided by an anchoring cable 30 attached to the steel catenary riser 20, such that the buoyancy device 40 does not float to the top surface of the body of water 100, and the curve portion of the steel catenary riser 20 can substantially maintain its pre-installed shape. One end of the anchor cable 30 is attached to the steel catenary riser 20 at an anchor point 31, while the other end of the anchor cable 30 is attached to a pile 33 disposed on the seabed 101. In free-standing mode, the anchor cable 30 is taut, as it provides a downward force on the pipeline 17 that counters the upward buoyancy force of the buoyancy device 40. The pipeline 17 above the anchor point 31 becomes perpendicular to the seabed 101, while the pipeline 18 below the anchor point substantially, though not completely, maintains the normal catenary profile.

As shown in FIG. 6, after the host vessel 10 arrives, the near end 21 of the steel catenary riser 20 is attached to receptacle 11 of the host vessel 10, and the buoyancy device 40 is removed therefrom. The catenary riser is attached to the host vessel 10, and the free-standing steel catenary riser system is in a host connection mode. The host vessel 10 provides enough upward force on the near end 21 of the steel catenary riser 20 to support the pipeline 17. Thus, the anchor cable 30 no longer needs to provide a counteracting force, and becomes slack. Alternatively, the anchor cable may be disconnected altogether. At this point, the pipeline functions as a normal steel catenary riser 20, and delivers fluid product from the offshore production site (not shown) to the host vessel 10. The pipeline 17 forming the catenary riser 20 may be disconnected from the host vessel 10, and the buoyancy device 40 may be reattached to the pipeline 17, if the need arises.

Advantageously, embodiments of the present disclosure provide a steel catenary riser that can be installed before the arrival of the host vessel. Therfore, installation cycles may be shortened. Further, if the steel catenary riser installation is integrated with the pipeline laying process, installation cost may be reduced.

Illustrative Embodiments

In one embodiment, there is disclosed an offshore riser system comprising a tubular from a sea floor to a sea surface comprising a first horizontal portion at the sea floor; a second vertical portion near the sea surface; and a third curved portion located between the first and second portions; and a buoyancy module connected to the second portion, adapted to maintain a shape of the curved portion and enable a connection of a vessel to the second portion. In some embodiments, the system also includes an anchor cable connected to the third portion and to an anchoring mechanism on the sea floor.

In some embodiments, the system also includes a host vessel connected to the second portion. In some embodiments, the host vessel comprises a spar, a semisub, an FPSO, or a TLP. In some embodiments, the system also includes at least one of a subsea well and a subsea manifold connected to the first portion. In some embodiments, an end of the second portion is at a depth of at least about 20 meters, for example at least about 50 meters.

In one embodiment, there is disclosed a method of installing an offshore riser system comprising laying a first horizontal portion of a tubular on a sea floor; connecting a second vertical portion of the tubular to a flotation module at or near a sea surface; forming a third curved portion between the first horizontal portion and the second vertical portion; connecting the second portion to a floating host vessel; and disconnecting the flotation module from the second portion. In some embodiments, the method also includes anchoring the third portion to the sea floor. In some embodiments, the method also includes keeping the second portion and the flotation module at a depth of at least 10 meters, for example at least about 25 meters. In some embodiments, the flotation module comprises at least one of a buoyancy can and a foam.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An offshore riser system comprising:

a tubular from a sea floor to a sea surface comprising:

a first portion at the sea floor, wherein the first portion is a horizontal portion;

a second portion near the sea surface, wherein the second portion is a vertical portion; and a third portion located between the first and second portions, wherein the third portion is a curved portion;

a buoyancy module connected to the second portion, adapted to maintain a shape of the third portion and enable a connection of a host vessel to the second portion;

the host vessel directly connected to the second portion; and wherein the buoyancy module is capable of being disconnected from the second portion after the connection of the host vessel to the second portion.

2. The system of claim 1, further comprising:

an anchor cable connected to the third portion and to an anchoring mechanism on the sea floor.

3. The system of claim 1, wherein the host vessel comprises a spar, a semisub, an FPSO, or a TLP.

4. The system of claim 1, further comprising:

at least one of a subsea well and a subsea manifold connected to the first portion.

5. A method of installing an offshore riser system comprising:

laying a first portion of a tubular on a sea floor, wherein the first portion is a horizontal portion;

connecting a second portion of the tubular to a flotation module at or near a sea surface, wherein the second portion is a vertical portion;

forming a third portion between the first portion and the second portion, wherein the third portion is a curved portion;

connecting the second portion directly to a floating host vessel; and disconnecting the flotation module from the second portion.

6. The method of claim 5, further comprising anchoring the third portion to the sea floor.

7. The method of claim 5, wherein the flotation module comprises at least one of a buoyancy can and a foam.

* * * * *